US008127697B2

(12) United States Patent
Himmelfreundpointner

(10) Patent No.: US 8,127,697 B2
(45) Date of Patent: Mar. 6, 2012

(54) METHOD AND DEVICE FOR CHARGING PROCESSING PLANTS

(76) Inventor: Kurt Himmelfreundpointner, Wels (AT)

( * ) Notice: Subject to any disclaimer, the term of this patent is extended or adjusted under 35 U.S.C. 154(b) by 377 days.

(21) Appl. No.: 12/088,331

(22) PCT Filed: Sep. 25, 2006

(86) PCT No.: PCT/AT2006/000389
§ 371 (c)(1),
(2), (4) Date: Mar. 27, 2008

(87) PCT Pub. No.: WO2007/035974
PCT Pub. Date: Apr. 5, 2007

(65) Prior Publication Data

US 2008/0236460 A1 Oct. 2, 2008

(30) Foreign Application Priority Data

Sep. 28, 2005 (AT) ..... GM 657/2005 U
Dec. 29, 2005 (AT) ..... A 2092/2005

(51) Int. Cl.
*F23K 3/14* (2006.01)

(52) U.S. Cl. ..... 110/110; 110/238

(58) Field of Classification Search ..... 110/110, 110/238
See application file for complete search history.

(56) References Cited

U.S. PATENT DOCUMENTS

| | | | | |
|---|---|---|---|---|
| 2,232,545 | A * | 2/1941 | Lum | 198/675 |
| 3,941,552 | A * | 3/1976 | Cottell | 110/347 |
| 4,232,615 | A * | 11/1980 | Brown | 110/342 |
| 4,577,567 | A * | 3/1986 | Moore et al. | 110/347 |
| 4,850,700 | A * | 7/1989 | Markus et al. | 366/132 |
| 5,372,077 | A * | 12/1994 | Yen et al. | 110/233 |
| RE35,251 | E * | 5/1996 | van den Broek | 110/221 |
| 5,746,144 | A * | 5/1998 | Breen et al. | 110/345 |
| 6,176,187 | B1 * | 1/2001 | Leonard et al. | 110/215 |
| 6,405,663 | B1 * | 6/2002 | Jones | 110/342 |

FOREIGN PATENT DOCUMENTS

| | | |
|---|---|---|
| GB | 1337116 | 11/1973 |
| WO | 9111659 | 8/1991 |

* cited by examiner

*Primary Examiner* — Kenneth Rinehart
*Assistant Examiner* — David J Laux
(74) *Attorney, Agent, or Firm* — Brooks Kushman P.C.

(57) ABSTRACT

A device and method for charging processing plants, in particular, combustion furnaces (1), is disclosed, in which a flowing process material (3), which has solid components (6) in addition to liquid components (5), is introduced into the processing plant (1), by means of a conveyor line (2) under pressure. According to the invention, advantageous charging conditions may be achieved, by means of mixing the process material (3) before pressurization.

2 Claims, 3 Drawing Sheets

METHOD AND DEVICE FOR CHARGING PROCESSING PLANTS

Figure 1:
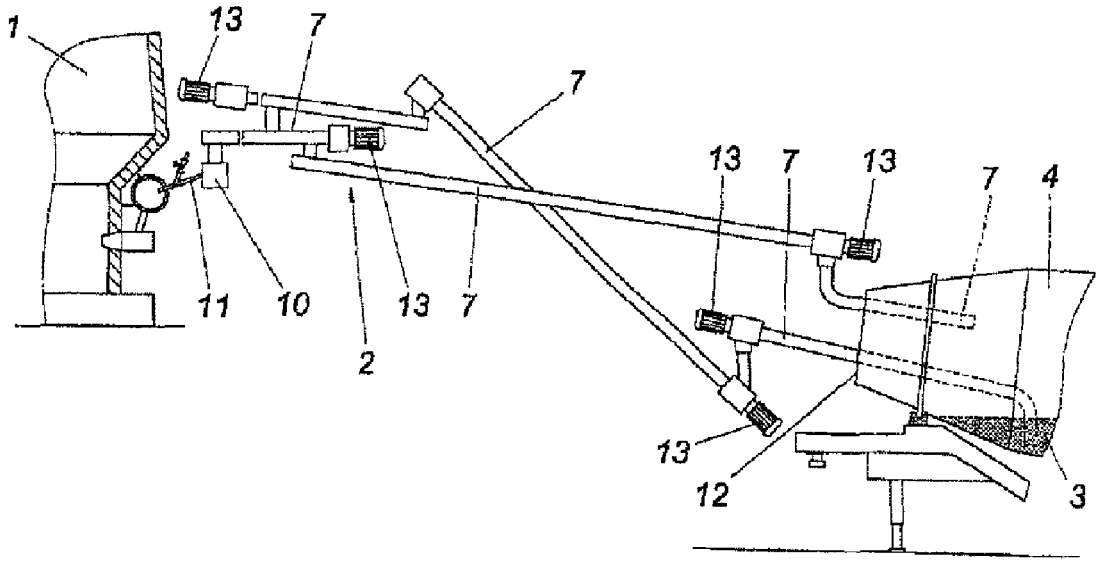

The invention relates to a device and a method for charging processing plants, in particular combustion furnaces, in which a flowing process material which has both liquid components and solid components is introduced under pressure into the processing plant via a feed line.

In order to be able to feed solid process material to a processing system which is embodied as a combustion plant without process material being carried along by the thermal buoyancy gases in an entirely or partially unburnt state, it is known to introduce solid process material together with liquid process material into the combustion furnace. It has become apparent that particularly the feeding of such a flowing process material with solid components and liquid components is difficult because the solid components have a tendency to become demixed from the liquid components. This frequently leads to blockages in the feed lines, which occurs in particular when the process material is fed under pressure. With the devices and methods which are currently known it is therefore not possible to ensure long service lives when charging a processing plant under pressure.

The object of the invention is therefore to provide a method and a device of the type described at the beginning which are defined by long service lives of the means for the pressurized charging of combustion furnaces with process material which has solid components and liquid components.

The invention is based on the object with respect to the method of ensuring that the process material is mixed before being pressurized.

If the process material is mixed before being pressurized, it is surprisingly possible to ensure, in contrast to the prior art, that the risk of blockages in the feed line remains low. It has in fact become apparent that with a mixed process material the solid components do not have a tendency, or only have a slight tendency, to become demixed during the feeding process, which has proven decisive for the occurrence of blockages. As a result, it is also not necessary to fear blockages in the feed line during a long charging operation, which, according to the invention, permits long service lives, in particular in processing plants which are embodied as combustion furnaces. Particularly in these plants, the process material is ultimately fed in a pressurized fashion through a feed line which is embodied as a lance which is particularly prone to blockage. According to the invention, the risk of blockages can also be reduced here.

If, during the mixing of the process material, the solid components are mixed approximately evenly in the liquid components, this reduces the risk of demixing even further. It has in fact become apparent that the solid components for the most part retain their distribution in the liquid components, which counteracts local collection of solid components and therefore a risk of blockage.

With non pressurized feeding, at least of the solid components until the pressurization occurs, the tendency of the solid components to demix can be reduced further, which is advantageous for the service life of the means for charging processing plants.

If the feed line is at least partially emptied when the processing plant is charged it is possible to avoid the solid components of the process material demixing in the feed line to such an extent that blockages occur in the feed line when the charging is continued.

The object of the invention in terms of the device is achieved by virtue of the fact that the feed line which preferably ends in the form of a lance is assigned a mixing device, in particular a drum mixer, which is mounted upstream of the pump and has the purpose of mixing the process material.

If the feed line is assigned a mixing device which is mounted upstream of the pump and has the purpose of mixing the process material, it is easily possible to ensure blockage free pressurized feeding of the process material since the risk of demixing of the solid components can be kept small. This is advantageous in particular if the feed line ends in the form of a lance. Simple design conditions are obtained if the mixer is embodied as a drum mixer.

If the feed line has a worm, it is not only possible according to the invention to feed the process material in a non pressurized state but it is also possible to ensure that the process material can be tapped in a virtually unchanged state in terms of its thorough mixing despite the feed process. To be precise, if a spiral feed worm is used there is no deposition of fluid components due to a gap and therefore the distribution is not changed. In contrast to the prior art, it is therefore possible to feed the process material without problems to a downstream pump for the application of pressure because, owing to the comparatively short transport path from the pumping to the processing plant using feed lines which are embodied as pipe lines or hose lines, the risk of demixing can be made negligible by taking into account the dimensions of the lines and the feed rate.

If the feed line between the pump and the mixer forms a ring line, it is easily possible to empty the feed line of process material when the charging is interrupted. Furthermore, the ring line can be connected to a pump which is arranged in the region of the processing plant in order to ensure pressurized introduction of a process material into the processing plant.

If the feed line which runs between the pump and processing plant has a connection for the addition of liquid and/or gaseous process substances it is therefore possible to empty this part of the feed line independently of the pump delivery capacity.

Figure 2:
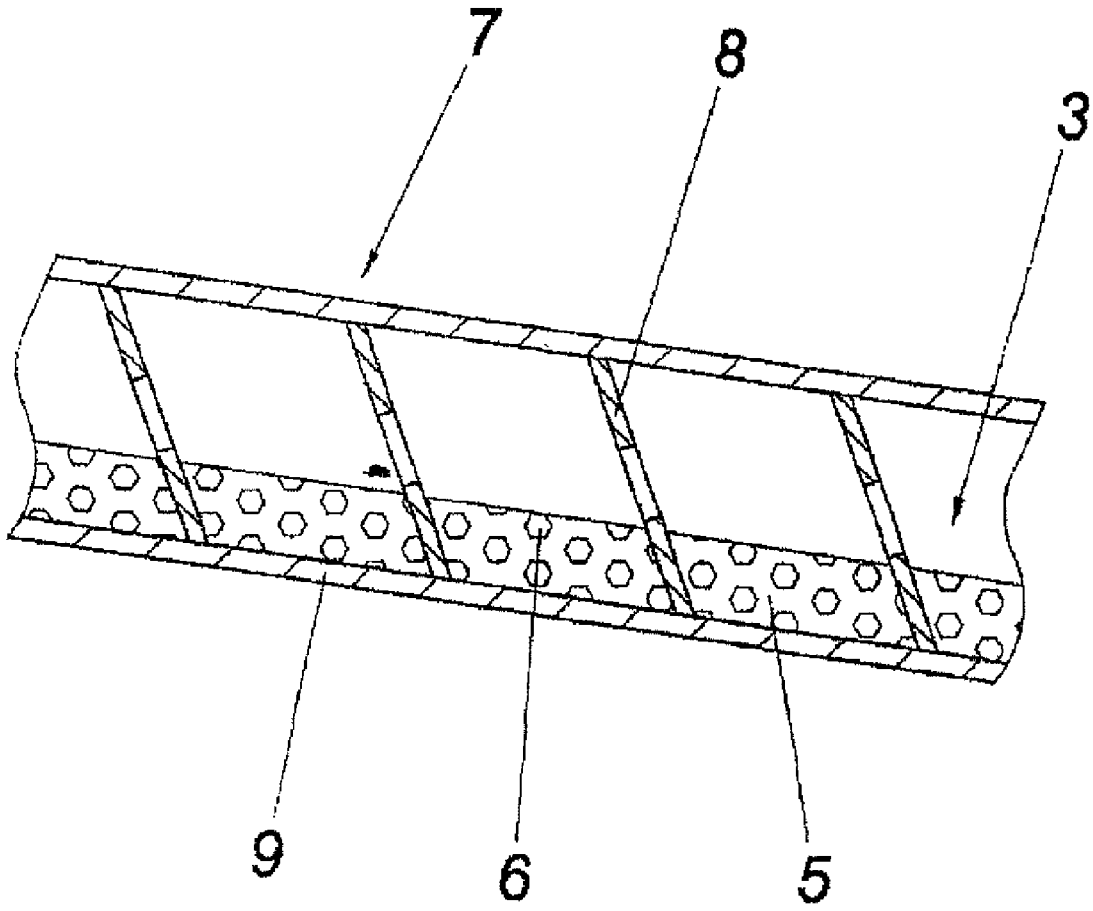
Figure 3:
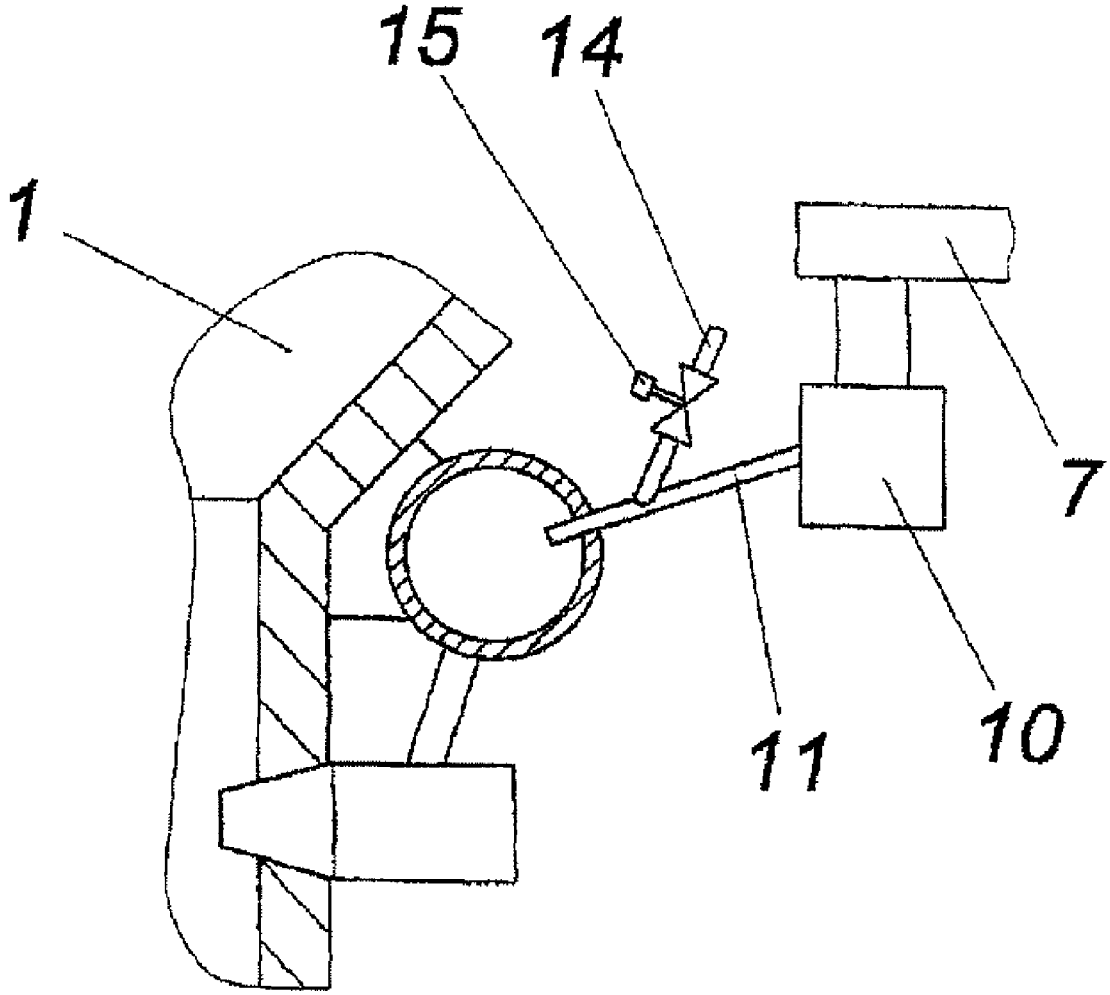

In the figures, the subject matter of the invention is illustrated by way of example by means of an exemplary embodiment. In the figures:

FIG. 1: shows a simplified view of the device for charging a processing plant, FIG. 2: shows an enlarged sectional view of the feed line according to FIG. 1, and FIG. 3: shows an enlarged partial view of the device according to FIG. 1.

The device (illustrated by way of example according to FIG. 1) for charging a processing plant which is embodied as a combustion furnace 1 has a feed line 2 with which a flowing process material 3 is taken up and introduced into the combustion furnace 1. The feed line 2 removes the process material 3 from a mixer which is embodied as a drum mixer 4 and which ensures that a process material 3 is always available to the feed line 2, in which process material 3 the fluid components 5 and solid components 6 are mixed, in particular solid components 6 are distributed approximately uniformly in the liquid components 5, which is apparent in particular from FIG. 2. Such flowing process material 3 can be, for example, oil or oil sludge mixed with plastics, metals and/or silicates.

FIG. 2 shows the feed line 2 which is embodied in this part as a spiral feed worm 7 and has the purpose of a non pressurized feeding of the process material 3. However, it is also conceivable to use, instead of the worm 7 for feeding the process material 3, a feed line 3 which is acted on by a pump, which feed line 3 has not been illustrated for reasons of clarity. A spiral feed worm has, compared to other methods of feeding, the advantage that demixing of the process material 3 is reduced during the feeding process since the worm elements 8 of the spiral feed worm 7 bear in a virtually positively locking fashion against the outer casing 9 and the fluid components 5 therefore cannot become separated from the fed volume component. With such non pressurized feeding it is possible to ensure virtually uniform distribution of the solid components 6 in the liquid components 5 of the process material 3 over the entire feed line 2, so that a pump 10, arranged in the region of the combustion furnace 1, can be charged without problems. The pump introduces the process material 3 in a pressurized state into the combustion furnace 1 via the feed line 2 which is embodied as a lance 11 in this part. For example a spiral pump can serve as the pump 10.

If the charging of the combustion furnace 1 is interrupted, the process material 3 is fed back into the drum mixer 4 using the feed line 2 which is embodied as a ring line between the drum mixer 4 and the pump 10 and it empties the feed line 2 at least in this area. For this purpose, the spiral feed worm 7 projects through the filling opening 12 of the drum mixer 4 into the process material 3 of the drum mixer 4. In order to be able to empty process material 3 also during the mixing process, the feed line 2 projects through the filling opening 12 into the drum mixer 4, the spiral feed worms 7 of the feed line 2 each being driven by a motor 13.

Furthermore, the lance 11 and the feed line 2 which runs between the pump and processing plant have a connection 14 to a closing valve 15 for adding liquid and/or gaseous process substances, which is clearer in FIG. 3. In the case of blockages, it is therefore possible to clean the lance 11 which ends in a cone shape.

The invention claimed is:

1. A device for charging combustion furnaces, the device comprising:

a drum mixer for mixing liquid and solid components together in a non-pressurized state, wherein the liquid components are selected from the group of oil, oil sludge and combinations of oil and oil sludge, and the solid components are selected from the group of plastics, metals, silicates and combinations thereof to form a process material mixture to be fed into the combustion furnace;

a first worm screw conveyor for lifting the process material mixture from the drum mixer and transferring the process material mixture in a non-pressurized state along a feed path from the mixer to a location proximate the combustion furnace;

a pump for pressurizing the process material mixture received from the worm screw conveyor and having an outlet in communication with the combustion furnace; and a process material return created by a motor driven second worm screw conveyor separate from the material feed path so that when operation of the furnace is interrupted, the non-pressurized process material mixture in the first feed worm conveyor can be returned to the mixer along a material return path so that the solid components do not settle and clog in the first worm screw conveyor.

2. The device as claimed in claim 1, wherein the pump outlet which communicates with the combustion furnace is further provided with an inlet port so that process material which may clog the outlet can be flushed out.

* * * * *